US005732582A

United States Patent [19]

Knudson

[11] Patent Number: 5,732,582

[45] Date of Patent: Mar. 31, 1998

[54] STRUCTURAL MEMBER FORMING APPARATUS AND METHOD

[76] Inventor: Gary A. Knudson, 30401 Heavenly Ct., Evergreen, Colo. 80439

[21] Appl. No.: 671,250

[22] Filed: Jun. 27, 1996

[51] Int. Cl.[6] ..... B21D 5/08

[52] U.S. Cl. ..... 72/131; 72/181

[58] Field of Search ..... 72/131, 129, 181, 72/179

[56] References Cited

U.S. PATENT DOCUMENTS

| | | | |
|---|---|---|---|
| 1,673,787 | 6/1928 | Frahm | 72/181 |
| 3,006,224 | 10/1961 | Celovsky | 72/181 |
| 3,270,541 | 9/1966 | Tishken | 72/181 |
| 3,595,056 | 7/1971 | Hutton | 72/181 |
| 3,791,185 | 2/1974 | Knudson | 72/181 |
| 3,886,779 | 6/1975 | McClain | 72/181 |
| 4,112,722 | 9/1978 | Boucard | 72/181 |
| 4,285,222 | 8/1981 | Jagelid | 72/181 |
| 4,899,566 | 2/1990 | Knudson | 72/129 |
| 5,038,592 | 8/1991 | Knudson | 72/181 |
| 5,148,694 | 9/1992 | Pearson et al. | 72/181 |

*Primary Examiner*—Daniel C. Crane
*Attorney, Agent, or Firm*—Ancel W. Lewis, Jr.

[57] ABSTRACT

Apparatus and method is disclosed for forming a variety of shapes and sizes of shaped structural members. The apparatus and method includes a first portion on a traveling plate having successive sets of opposed upper and lower roller sections arranged so that the roller sections of one side are adjustable to the roller sections of the other side to partially form the sheet member and cut the member to a selected length. A second portion has successive sets of upper and lower rollers and also has movable roller sections along one side for adjustability. Adjustable entry guides in the front portion establish the lip dimension. The front portion is reoriented relative to the rear portion to establish flange height and the rear portion position determines the web width. Separate drive motors are provided for the first and second portions that are synchronized in operation by using hydraulic motors and hydraulic controls.

17 Claims, 5 Drawing Sheets

STRUCTURAL MEMBER FORMING APPARATUS AND METHOD

TECHNICAL FIELD

This invention relates to apparatus for making structural members and more particularly to continuous roll forming apparatus for making a heavier gauge structural member having a variety of shapes and dimensions.

BACKGROUND ART

There is need in the industry to be able to readily change the shape and dimensions of roll-formed structural members. Presently, there is no known apparatus or method that has been entirely satisfactory for meeting these needs.

Knudson U.S. Pat. No. 3,791,185 discloses apparatus for forming siding for buildings wherein the lower of each pair of a group of pairs of rollers are dropped down so that the same apparatus may be used to form different siding shapes.

Knudson U.S. Pat. No. 4,899,566 discloses pairs of rollers in roll-forming apparatus having lateral adjustments of the rollers in each pair to form shaped panels having different panel widths from the same rollers.

Attempts have been made to provide metal roll forming apparatus that will adjust to make members of different shapes and sizes. Knudson U.S. Pat. No. 5,038,592 discloses roller sections that have selective axial adjustments to change the width of the formed member.

Pearson et al U.S. Pat. No. 5,148,694 discloses sets of rollers on one side that move relative to axially aligned sets of roller on the other side to vary the width of a formed member.

DISCLOSURE OF THE INVENTION

Roll forming apparatus and method are disclosed for making structural members of a heavier gauge material in which the web width, the side flange height and inturned lip dimensions can be changed to meet specific requirements. The apparatus includes a base, a first portion including a traveling plate, left and right side entry guides on the plate and first roll forming stations on the plate having successive sets of opposed first upper and lower roller sections along one side are laterally movable relative to associated fixed axially aligned first sets of upper and lower roller sections, and a cutter on the traveling plate that shears the partially formed structural member to a selected length. The traveling plate is adjustable relative to the frame. The entry guides are adjustable to change the dimension of the lips. The traveling plate is adjustable to change the dimension of the first flange. The first movable roller sections are adjustable to change the dimension of the second flange. A second portion beyond the first portion includes a second section of second roll forming stages that further forms the member and a third section of third roll forming stations that further forms the member to the final structural member. The second and third roll forming sections have second and third pairs of upper and lower roller sections along one side laterally movable relative to an associated axially spaced sets of upper and lower roller sections. The second and third movable roller sections are adjustable to change the dimension of the web. Separate drive motors are provided for the first and second portions that are synchronized in operation by using hydraulic motors and hydraulic controls.

BRIEF DESCRIPTION OF THE DRAWINGS

Details of this invention are described in connection with the accompanying drawings which like parts bear similar reference numerals in which.

DETAILED DESCRIPTION

Figure 1:
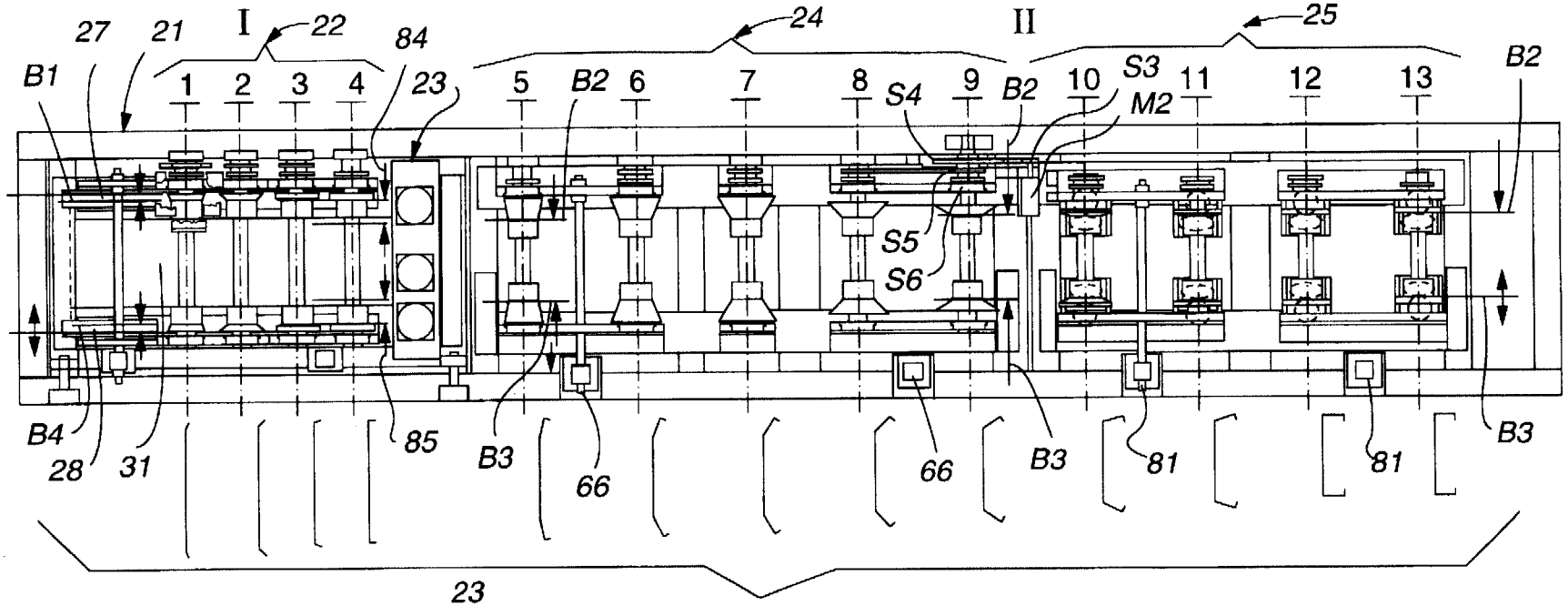
FIG. 1 is a top plan view of apparatus embodying features of the present invention and along the right side outlines of the member being formed are shown to illustrate the progression of the member through the apparatus for forming a sheet member into a generally C-shaped structural member.
Figure 2:
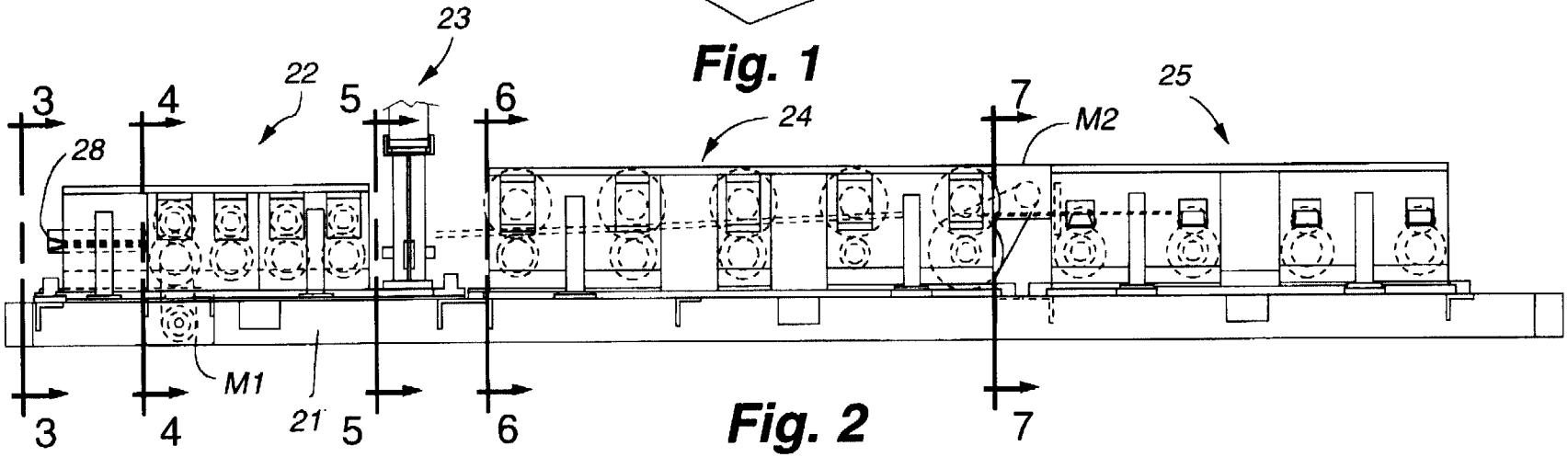
FIG. 2 is a right side elevation view of the apparatus of FIG. 1.
Figure 8:
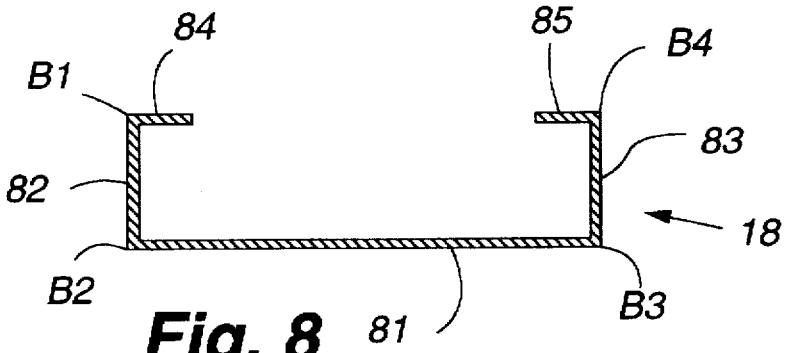
FIG. 8 is a cross-sectional view of the formed structural member having side flanges of equal dimension and lips of equal dimension.
Figure 9:
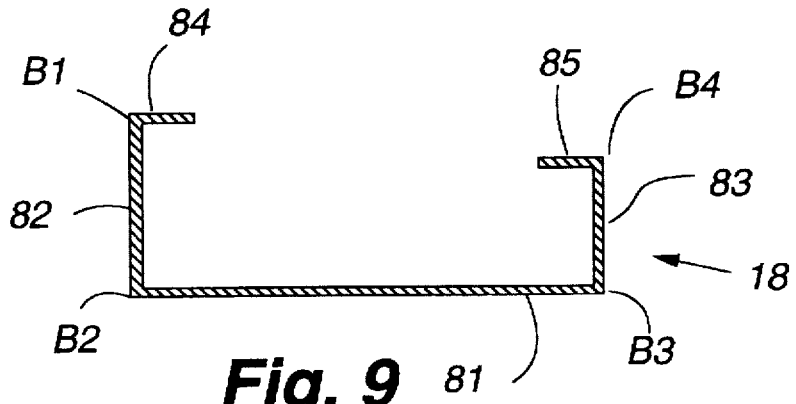
FIG. 9 is a formed structural member with uneven side flanges.

Referring now to FIGS. 1, 2 and 8 the apparatus shown, briefly stated, has a base 21 together with a first portion I having a first section 22 and a cutting assembly 23 and a second portion II having a second section 24, and a third section 25 all mounted on base 21. The heavier gauge material that can be shaped is up to between about eighteen to twelve gauge.

The first section 22 has a pair of laterally spaced left side entry guide 27 and right side entry guide 28 and has four successive roll forming stages identified by numbers 1, 2, 3 and 4. A flat traveling plate 31 rests on the base 21 and is laterally movable or adjustable relative to the flange in both directions by actuating a lead screw 32 to change the dimension of the first flange described hereafter. Each stage of the first section has an upper roller arrangement 34 on an upper shaft 35 and a lower roller arrangement 36 on a lower shaft 37 with the shafts 35 and 37 being supported in bearings in laterally spaced left and right upright side supports 38 and 39. Each upper roller arrangement 34 of the first section 22 has a fixed roller section 41 on the left side and a laterally movable adjustable roller section 42 along the right side as viewed from the entry end. Each lower roller arrangement 36 of the first section has a fixed roller section 43 on the left side and a movable adjustable roller section 44 on the right side. The left side roller sections are fixed to the traveling plate 31 and the right side roller sections move laterally on the traveling plate 31 as indicated by arrows to change the dimension of the second flange described hereafter.

The entry guides 27 and 28 engage the edge of the strip of sheet material so that by laterally moving each entry guide, the entry guide will determine where the strip hits the first set of forming rollers (stage 1) and therefore the entry guide then determines the dimension of the first and second lips described hereafter.

Figure 3:
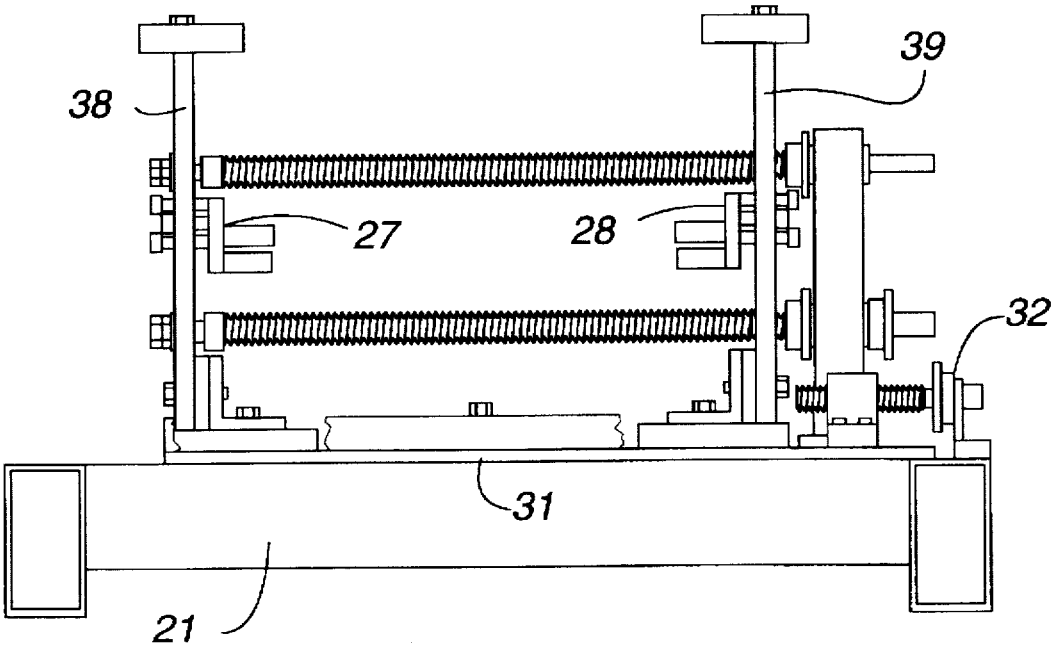
FIG. 3 is a sectional view taken along line 3—3 of FIG. 2.

As shown in FIG. 3, the left side entry guide 27 is mounted on thumb screws that thread into left side support 38 which enable guide 27 to be adjusted laterally relative to the fixed rollers of the first section 22 to establish the dimension of the first lip described hereafter. The right side entry guide 28 is mounted on thumb screws that thread into right side support 39 which enable guide 28 to be adjusted laterally relative to the movable roller sections of the first section 22 to establish the dimension of the second lip described hereafter.

Figure 4:
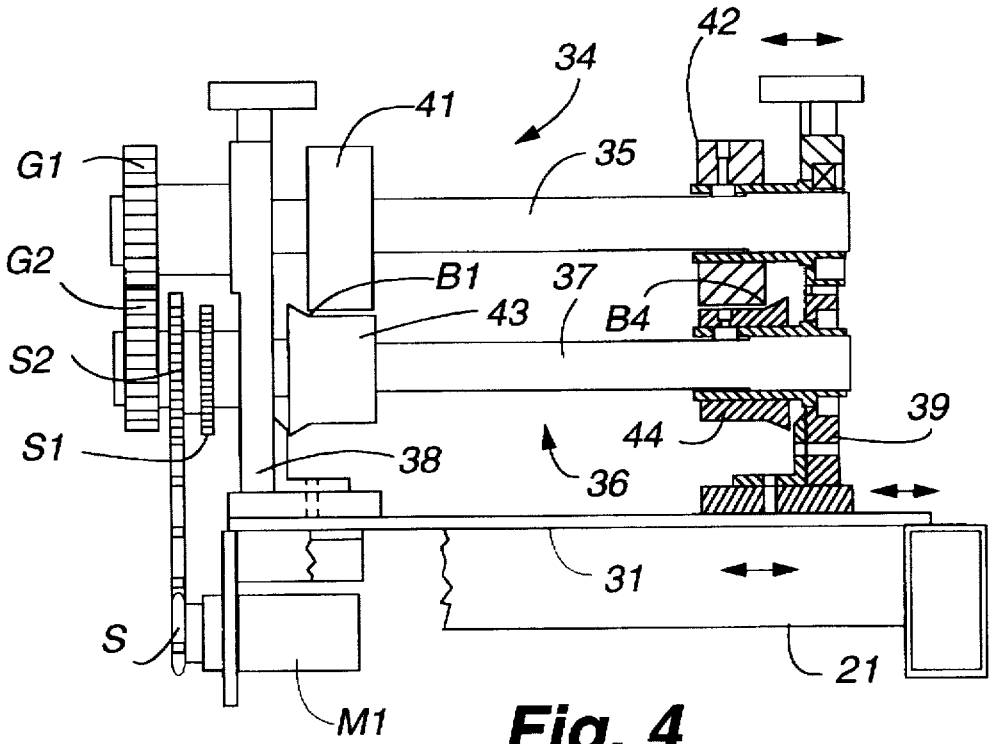
FIG. 4 is a sectional view taken along line 4—4 of FIG. 2.
Figure 5:
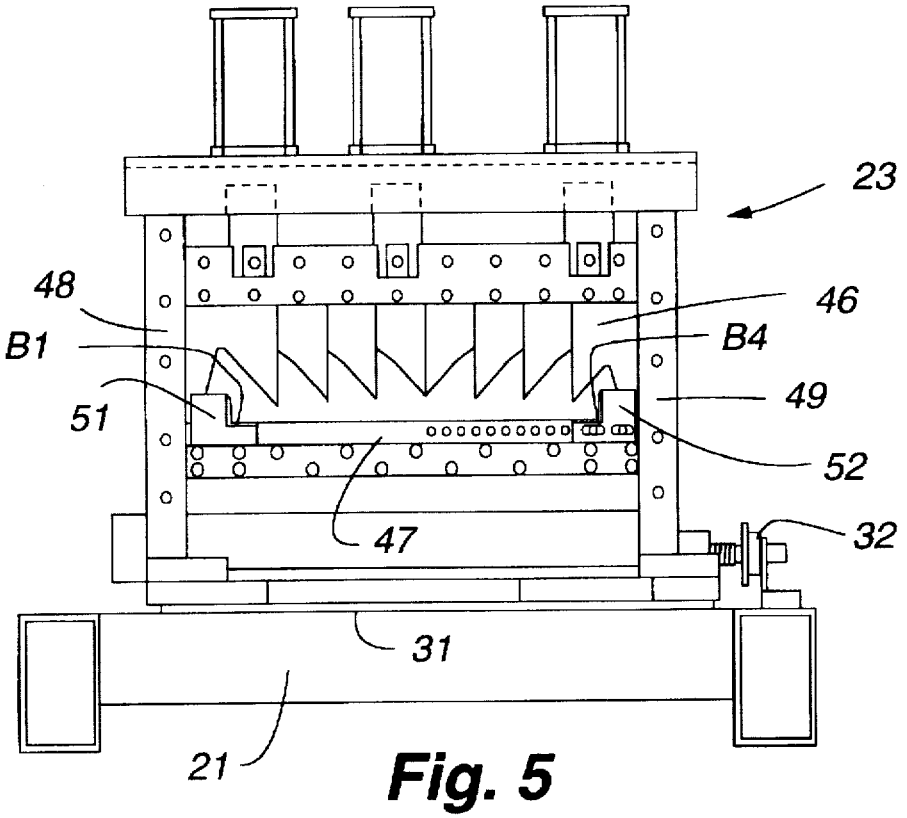
FIG. 5 is a sectional view taken along line 5—5 of FIG. 2 showing the cutter assembly.

As seen in FIG. 4, both upper and lower shafts of each stage of the first section 22 have meshing gears G1 and G2 on the left ends and drive sprockets S1 and S2 on the lower shaft so as to be driven by a drive motor M1. Motor M1 is coupled to sprocket S2 by a chain and sprocket S1 drives the next stage of the first section via a chain. This is repeated for each succeeding stage of the first section 22 so all of the rollers of this section are power driven.

The cutting assembly 23 mounts on the traveling plate 31 to move therewith. The cutting assembly 23 has an upper shear blade 46 and a bottom shear die 47 supported by a pair of laterally spaced side supports 48 and 49. A left shear die 51 is fixed to the bottom of bottom shear die 47 and is located based on bend point B1 on the formed member and the right side shear die 52 is laterally adjustable to different positions to correspond with bend point B4 on the formed member.

Upper shear blade 46 has a plurality of similarly shaped saw tooth blade sections to provide for selective orientation of blade sections. The shorter blade sections are in the middle. These blade sections are selected in size and length to match the width of the structural member being formed. With a plurality of blade sections the upper shear blade 46 can be centered to approximately the center of the member being cut.

The ability to adjust the sawtooth blades in the shear allows profiles of differing widths to be sheared symmetrically, which becomes more and more important with heavier gauge materials.

When an angular blade section pierces material and begins the shearing process, a combination of forces are exerted on the profile. As the angular blade section travels downward and shears, it exerts force perpendicular to the angled face of the blade section. This force may be separated into two vector components. The downward component pushes the profile down against the bottom shear die, and the sidewards component pushes the profile sideways.

If the blade teeth are assembled with a blade arrangement generally symmetrical about the center of the profile (point in the center of the profile with angular part of blade sections facing outward from the center of the profile), the side forces on the profile experienced during the shearing process will be balanced side to side. When balanced, the bottom dies counter the downward shear force, while the balanced side forces work against themselves. In this situation, the profile maintains its position in the machine relative to both the forming rollers and the shear assembly.

If the sawtooth blade teeth are not assembled symmetrically about the profile center, the shear side forces will not be balanced. If the side forces are unbalanced during shear, the profile will be forced sideways into one of the side dies. When forced sideways, the profile can become somewhat misaligned with the forming rollers and the shear assembly, ultimately causing profile distortion.

In addition, the sawtooth blade lengths vary symmetrically about the center blades. The center blades are the shortest, and the blade lengths gradually increase as they move outward. Another part of maintaining even side forces includes simultaneous contact on either side of the profile by the blades. When arranged symmetrically, the profile will be pierced on either side of it's own center at the same time by equal length blades. Blades not arranged symmetrically about the profiles center will create a situation where the longest blade (typically on the left side of the shear assembly) will contact the profile first, with no counter on the profile's right side. Again, distortion and unbalanced side forces result.

Therefore, the ability to adjust the shear blades becomes critical to avoiding profile distortion when multiple profiles can be run through the same shear assembly.

The second section 24 has five roll forming stages identified by numbers 5, 6, 7, 8, and 9. Each stage of the second section has an upper roller arrangement 55 on an upper shaft 56 and a lower roller arrangement 57 on a lower shaft 58 with the shafts being supported in bearings in a pair of laterally spaced left and right side supports 61 and 62. Each upper roller arrangement 55 has a fixed roller section 64 along one side and a movable adjustable roller section 65 along the other side. Each lower roller arrangement 57 of the second section has a fixed roller section 59 on the left side and a movable or adjustable roller section 60 on the right side. These movable roller sections are adjusted by a pair of lead screws 66.

Figure 6:
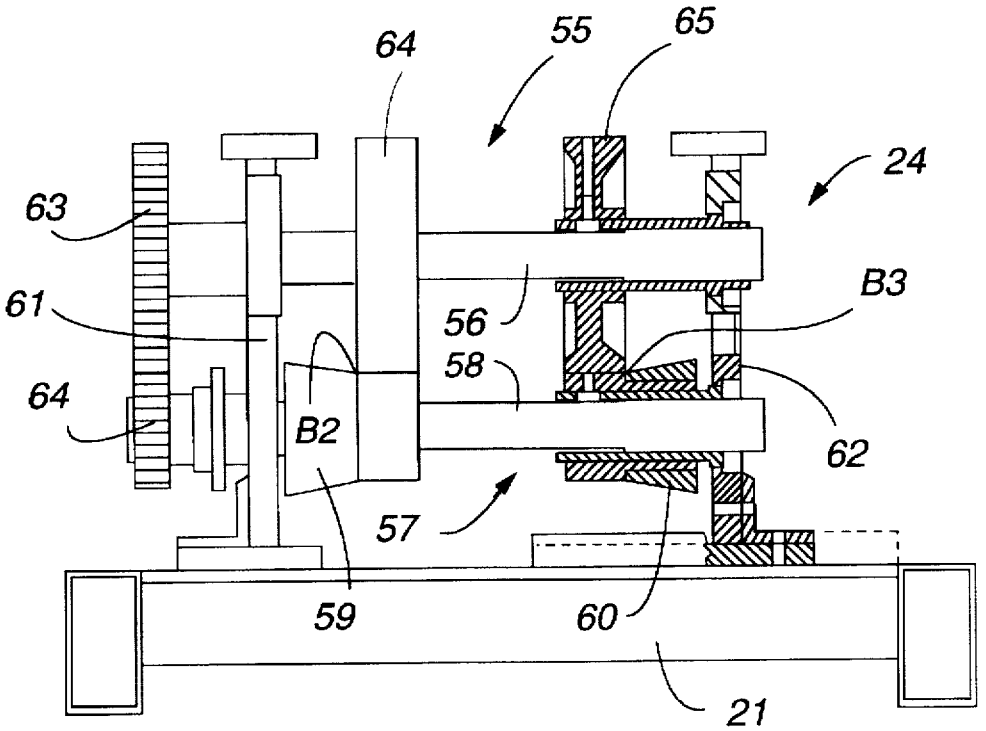
FIG. 6 is a sectional view taken along line 6—6 of FIG. 2.
Figure 7:
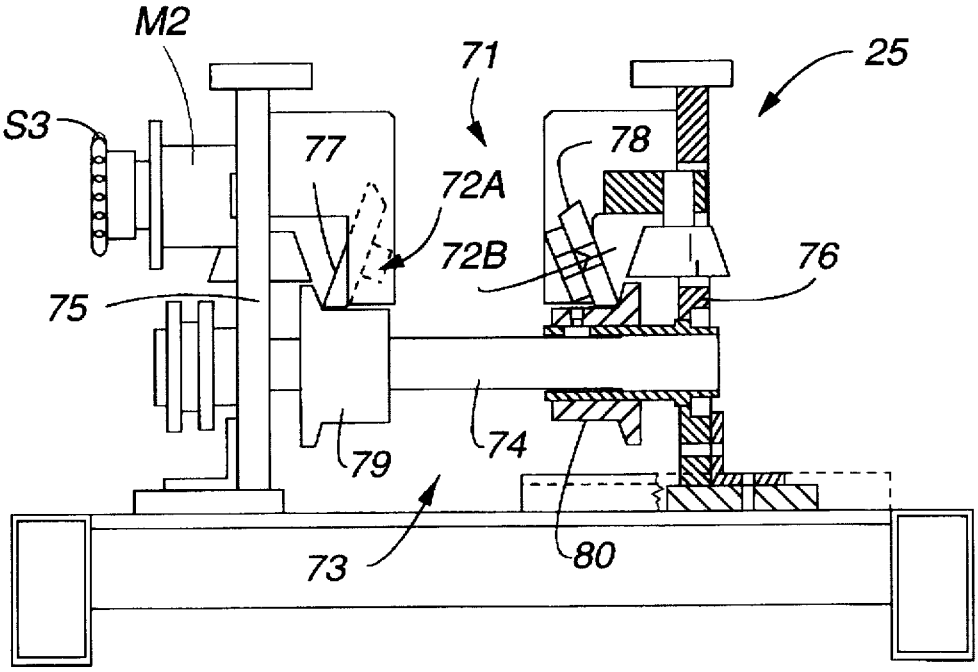
FIG. 7 is a sectional view taken along line 7—7 of FIG. 2.

As seen in FIG. 6 both the upper and lower shafts of each stage of the second section have meshing gears 63 and 67 on the left ends. The motor M2 is mounted downstream of stage 9 and shown in FIG. 7. Motor M2 has a drive sprocket S3. Sprocket S3 drives sprocket S4 at station 9 as seen in FIG. 1. Sprocket S5 powers stations 5–8. Sprocket S6 drives forward and drives stages 10–13 so that all of the shafts and rollers of sections 2 and 3 are power driven.

The third section 25 has four roll forming stages identified by numbers 10, 11, 12 and 13. Each of these stages has an upper roller arrangement 71 on upper shafts 72A and 72B comprising separate rollers on separate shafts and a lower roller arrangement 73 on a lower shaft 74 with the shafts being supported in bearings in a pair of oppositely disposed side supports 75 and 76. Each upper roller has a fixed roller section 77 and a movable roller section 78. Each lower roller of the third section has a fixed roller section 79 on the left side and a movable roller section 80 on the right side. The movable sections are adjusted to move in either direction on the flange by a pair of lead screws 99 (FIG. 1).

Referring now to FIG. 8 the formed structural member 18 shown has a web 81, a first side flange 82, a second side flange 83, a first lip 84 and a second lip 85. For reference purposes B1 is a bend point at the left end of first lip 84 and at the top of the first side flange 82. B2 is a bend point at the bottom of side flange 82 and at the left side of web 81. B3 is a bend point at the right side of web 81 and at the bottom of side flange 83. B4 is a bend point at the top of side flange 83 and at the right side of lip 85.

Referring now to FIGS. 1 and 4, B1 is indicated as a straight line along the left side of the first section where the bottom rollers form a bend against the top rollers. As seen in FIGS. 1 and 6, B2 is a straight line along the left side of the second and third sections where the bottom rollers form a bend against the top rollers. As seen in FIGS. 1 and 6, B3 is a straight line along the right side of the second and third sections where the bottom rollers form a bend against the top rollers. As seen in FIGS. 1 and 4, B4 is a straight line along the right side of the first section. The web 81, between B2 and B3, is arranged so that B2 is fixed permanently to the frame and B3 is laterally adjusted relative to the frame by moving the right side sets of upper and lower roller sections in the second and third sections to change the dimension of the web 81. The first flange 82, between points B1 and B2, is formed by having B1 fixed to the traveling plate 31 and the traveling plate 31 is adjusted relative to the frame to change the dimension of first flange 82. The second flange 83, between points B3 to B4, is arranged so that B4 and therefore the dimension of flange 83 is adjusted relative to the traveling plate (in the same way B3 is adjusted relative to the frame). Because the traveling plate 31 and point B4 are both adjustable, the operator needs to aim point B4 relative to point B3. The left entry guide 27 is adjusted relative to point B1 to change the dimension of the first lip 84. The right entry guide 28 is adjusted relative to B4 to change the dimension of second lip 85. Note that the maximum dimensions of the lips vary proportionally to the flange.

The shear or cutter assembly 23 is affixed to the traveling plate 31 and has the left die co-positioned with line B1 for alignment. The right hand die 52 is adjusted to align with line B4.

Figure 10:
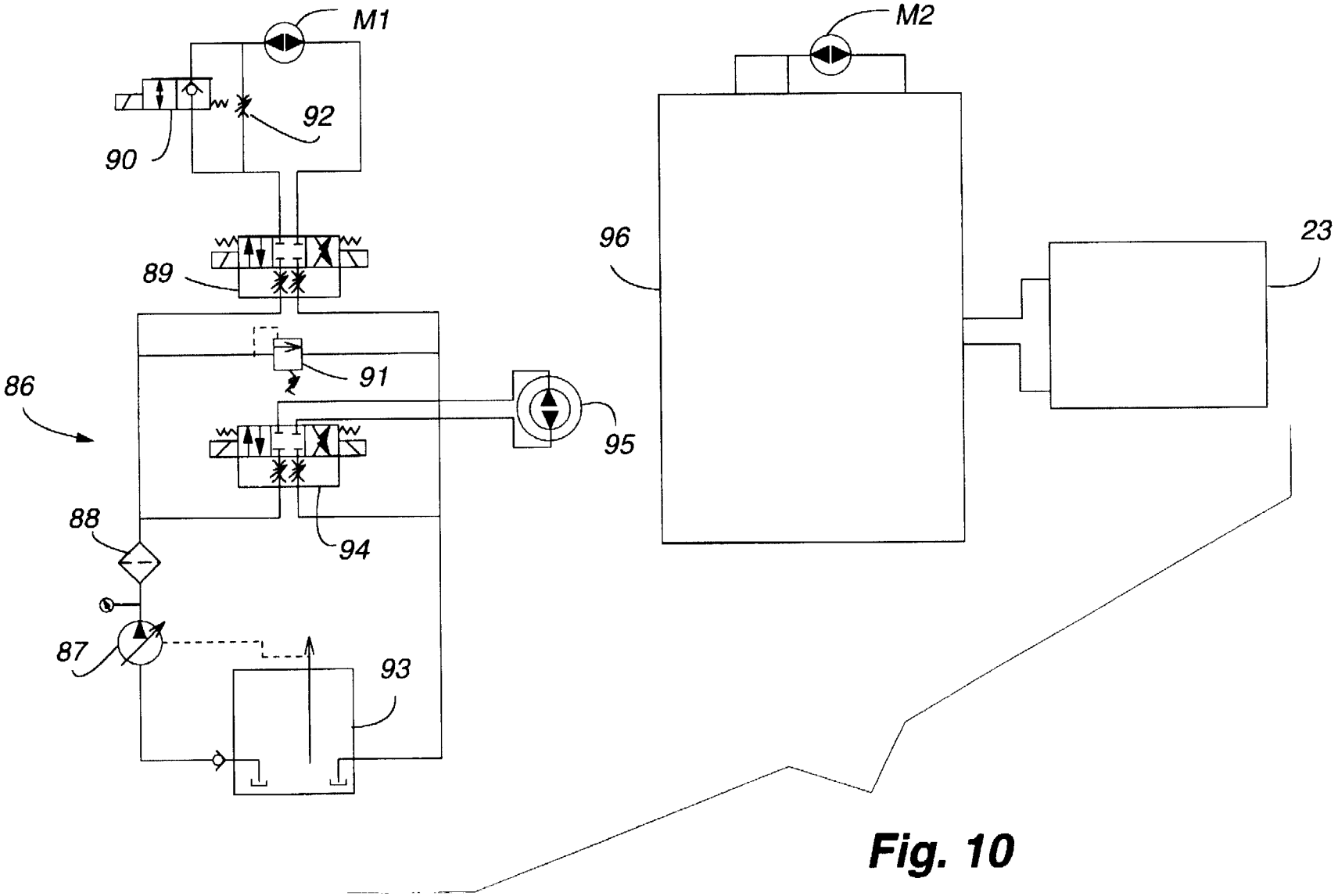
FIG. 10 is a schematic diagram of the hydraulic drive train.

Referring now to FIG. 10 the drive trains for the motors will now be described. The first drive train 86 for motor M1 (a hydraulic motor) includes a series circuit having a pump 87, filter 88, directional valve 89, and solenoid valve 90. A manifold relief valve 91 is connected across valve 89. A flow control 92 is connected across solenoid valve 90. The pump 87 pumps fluid through the series circuit and a sump 93 receives fluid from the motor M1 and valves 89 and 94. There is also provided in another circuit receiving fluid from pump 87 a directional valve 94 and a motor 95 that drives a coil handler for feeding coil stock to the apparatus.

Motor M2 is driven by a rear drive train 96 having the same components as drive train 86. This assembly also has a valve like directional valve 94 that supplies fluid to power the shear 23. The use of a hydraulic system makes it possible to synchronize the two independent drive systems for motors M1 and M2. The components of the front portion drive train are selected to allow the front portion I to run faster than the rear portion II. The pump 87 and the corresponding pump in train 96 are pressure compensated pumps rather than fixed displacement pumps so that the hydraulic motor speed is determined by the amount of torquing resistance faced rather than the specific revolutions of the hydraulic pump. The front and rear portions I and II are synchronized to run at approximately the same speed but the torquing load of the material bridging both portions I and II forces the motors M1 and M2 to share the torque and therefore become self-synchronizing when forming the material.

By way of illustration and not limitation the components of the above drive train are listed as follows:

| Part | Manufacturer | Part No. |
|---|---|---|
| 87 | Vickers | PVQ-16 |
| 88 | Curtiss | 4536AA-10RL |
| 89 | Vickers | DGMFN-3-4-A2W-B2W-41 |
| 90 | Vickers | SV1-10-C |
| 91 | Vickers | RV1-10-S-0-18 |
| 92 | Vickers | DGMFN-3-VA2W-41 |
| 93 | Hycon | BF3-10-1.0 |
| 94 | same as 89 | |

The above described apparatus, broadly stated, may be viewed as two variable width U-channel machines in-line with one another. The front portion I may be viewed as the first variable width U-channel machine, and the rear portion II may be viewed as the second variable width U-channel machine. The first U-channel machine is mounted on the traveling plate 31 and can be moved side to side. The second U-channel machine is fixed to the frame. The drive train for the front portion I is mounted to the traveling plate 31, and therefore moves side to side with the front portion I. The drive train for the rear portion II is affixed to the frame. The front portion I includes the entry guides 27 and 28, the first section 22 and the cutter assembly 23 which move with the traveling plate and the rear portion II has the second and third sections 24 and 25. Briefly stated, the front portion I is oriented relative to the rear portion II and in the front portion I the sides of the sheet metal are bent up a certain amount to form the lips. Then the rear portion II is set in relation to a selected web width. The rear portion II determines the width of the web. The entry guides are set for strip width. The front portion I has to reorient itself in relation to the rear portion II to establish the desired side flange height. The movement of the front portion I establishes the unevenness of the side flange height.

Although the present invention has been described with a certain degree of particularity, it is understood that the present disclosure has been made by way of example and that changes in details of structure may be made without departing from the spirit thereof.

What is claimed is:

1. Apparatus for making a variety of shapes and sizes of shaped structural members having a web, a first side flange, a second side flange, a first lip and a second lip comprising:

a base, a first portion mounted on said base for forming a sheet member into a partially shaped member, said first portion having a traveling plate mounted for movement on said base, a left side entry guide mounted on said traveling plate, a right side entry guide mounted on said traveling plate, a selected number of successive first roll forming stages on said traveling plate, each said stage having a first upper roller and a first lower roller, each first upper roller having a first fixed roller section and a first movable roller section, said first lower roller having a first fixed roller section and a first movable roller section, said first fixed upper and lower roller sections forming the first lip, said first movable upper and lower roller sections forming the second lip, and a cutting assembly mounted on said traveling plate to cut said partially shaped member to a selected length, said left entry guide being adjustable relative to said first fixed roller section to change the dimension of the first lip, said right entry guide being adjustable relative to said first movable roller sections to change the dimension of the second lip, said traveling plate being adjustable relative to said frame to change the dimension of the first flange, said first movable roller sections being adjustable relative to said traveling plate to change the dimension of the second flange, a second portion mounted on said base to shape said partially shaped member into a shaped structural member, said second portion having a selected number of successive second roll forming stages, each second roll forming stage having a second upper roller and a second lower roller, each second upper roller having a second fixed roller section and a second movable roller section, each second lower roller having a second fixed roller section and a second movable roller section, said second fixed upper and lower roller sections forming one end of the web, said second movable upper and lower roller sections forming an opposite end of the web, said second movable roller sections being adjustable relative to said frame to change the dimension of the web.

2. Apparatus as set forth in claim 1 wherein said first portion is at the front and said second portion is at the rear in relation to the direction of travel of the sheet member.

3. Apparatus as set forth in claim 1 wherein said second portion has two sections each having a selected number of successive roll forming stages.

4. Apparatus as set forth in claim 3 including means to drive all of said rollers of said two sections.

5. Apparatus as set forth in claim 1 wherein the upper roller and lower roller of each of said first and second roll forming stages are supported on shafts rotatable in bearings in pairs of laterally spaced upright side supports.

6. Apparatus as set forth in claim 1 including means to drive all of said rollers of said first roll forming stages.

7. Apparatus as set forth in claim 1 wherein said cutting assembly has an upper shear blade and a lower shear blade, said upper shear blade having a plurality of tooth blade sections selected in size and length to match the width of the blade being formed and enable the upper shear blade to be centered at approximately the center of the member being cut.

8. Apparatus as set forth in claim 1 wherein said cutting assembly has a left shear die fixed to the bottom of said bottom shear die and a right shear die adjustable to different positions to correspond to a bend point in the member being formed.

9. Apparatus as set forth in claim 1 wherein said sheet member is up to between about eighteen to twelve gauge.

10. Apparatus for making a variety of shapes and sizes of shaped structural members having a web, a first side flange, a second side flange, a first lip and a second lip comprising:

a base, a first portion including a first section mounted on said base for forming a sheet member into a partially shaped member, said first section having a traveling plate mounted for lateral movement on said base, a left side entry guide mounted on said traveling plate, a right side entry guide mounted on said traveling plate, a selected number of successive first roll forming stages on said traveling plate, each said stage having a first upper roller and a first lower roller, each first upper roller having a first fixed roller section and a first movable roller section, said first lower roller having a first fixed roller section and a first movable roller section, said first fixed upper and lower roller sections forming the first lip, said first movable upper and lower roller sections forming the second lip, and a cutting assembly mounted on said traveling plate to cut said partially shaped member to a selected length, a second portion including a second section mounted on said base to shape said partially shaped member to a further shaped member, said second section having a selected number of successive second roll forming stages, each second roll forming stage having a second upper roller and a second lower roller, each second upper roller having a second fixed roller section and a second movable roller section, each second lower roller having a second fixed roller section and a second movable roller section to provide successive sets of movable opposed second upper and lower roller sections along one side, said second movable upper and lower roller sections forming an opposite end of the web, and a third section mounted on said base to further shape said further shaped member to a shaped structural member, said third section having a selected number of successive third roll forming stages, each said third roll forming stage having a third upper roller and a third lower roller, each third upper roller having a fixed third roller section and a movable third roller section, each lower third roller having a fixed third roller section and a movable third roller section to provide successive sets of movable opposed third upper and lower roller sections along one side, said fixed second and third upper and lower roller sections forming one end of the web of the member, said movable second and third upper and lower roller sections forming an opposite end of the web of the member, said second and third movable roller sections being adjustable relative to said frame to change the dimension of the web.

11. Apparatus for making a variety of shapes and sizes of shaped structural members having at least a web, a first side flange, and a second side flange comprising:

a base, a first variable width roll forming portion for forming a sheet member into a partially shaped member, said roll forming portion including a first upper roller section on one side and a second upper roller section on an opposite side, one of said first and second upper roller sections being movable relative to a traveling plate and a first lower roller section on one side and a second lower roller section on an opposite side, one of said first and second lower roller sections being movable relative to said traveling plate, said roll forming portion being mounted on said traveling plate arranged for side to side movement on said base so as to provide for simultaneous movement of said upper roller sections and said lower roller sections relative to said base, a second variable width roll forming portion mounted to shape said partially shaped member into a shaped structural member, said second portion being fixed in relation to said base, said traveling plate being moved to vary the dimension of said side flanges of said shaped structural member.

12. Apparatus as set forth in claim 11 wherein said first portion has a first drive motor and said second portion has a second drive motor, a first drive train for said first drive motor, a second drive train for said second drive motor, said first and second drive trains being automatically synchronized when said drive motors are driving the sheet member being shaped.

13. Apparatus as set forth in claim 12 wherein said first drive motor has the capacity of running faster than said second drive motor.

14. Apparatus as set forth in claim 12 wherein said drive motors and drive trains are hydraulic.

15. Apparatus as set forth in claim 14 wherein each of said drive trains includes a pressure compensated pump so that the motor speed is determined by the amount of torquing resistance applied to the associated motor.

16. A method of making a variety of shaped and sizes of structural members having a web, a first side flange, a second side flange, a first lip and a second lip comprising the steps of:

providing a first portion having a series of roll formed stages and a cutter assembly which move on a traveling plate, providing a second portion having a series of roll forming stations, orienting a pair of entry guides relative to said first portion to establish initial bends in a sheet material to form the lips, positioning the second portion to establish a bottom web of a selected dimension, adjusting the entry guides to set the dimension of the lips, and reorienting the first portion in relation to the second portion by moving the traveling plate to establish selected flange dimension.

17. A method as set forth in claim 16 including providing separate hydraulic drive motors for said first portion and said second portion and synchronizing the operation of said drive motors by hydraulic control and pressure compensated pumps.

* * * * *